US007785179B2

(12) United States Patent
Ionescu

(10) Patent No.: US 7,785,179 B2
(45) Date of Patent: Aug. 31, 2010

(54) MECHANICAL AND ELECTRONIC COMBINATORY GAME AND PUZZLE

(76) Inventor: Pancu Mihai Ionescu, 1841 Howe La., Maple Glen, PA (US) 19002-2941

( * ) Notice: Subject to any disclaimer, the term of this patent is extended or adjusted under 35 U.S.C. 154(b) by 2239 days.

(21) Appl. No.: 10/389,606

(22) Filed: Mar. 15, 2003

(65) Prior Publication Data

US 2003/0232636 A1 Dec. 18, 2003

Related U.S. Application Data

(60) Provisional application No. 60/388,940, filed on Jun. 14, 2002.

(51) Int. Cl.
*A63F 13/00* (2006.01)

(52) U.S. Cl. ..... 463/9

(58) Field of Classification Search ..... 273/157 R; 463/9

See application file for complete search history.

(56) References Cited

U.S. PATENT DOCUMENTS

| | | | | | |
|---|---|---|---|---|---|
| 1,251,400 | A | | 12/1917 | Mees | |
| 1,518,889 | A | | 12/1924 | Wooster | |
| 2,052,848 | A | | 9/1936 | Schilling | |
| 2,886,325 | A | | 5/1959 | Long | |
| 3,655,201 | A | * | 4/1972 | Nichols | 273/153 R |
| 3,845,959 | A | | 11/1974 | Kosarek | |
| 4,021,939 | A | | 5/1977 | May | |
| 4,036,503 | A | | 7/1977 | Golick | |
| 4,407,502 | A | * | 10/1983 | Paulos | 273/153 S |
| 4,424,971 | A | | 1/1984 | Clark | |
| 4,428,581 | A | | 1/1984 | Nagomy | |
| 4,437,667 | A | | 3/1984 | Miller | |
| 4,488,725 | A | | 12/1984 | Clark | |
| 4,494,756 | A | | 1/1985 | Winer | |
| 4,687,207 | A | | 8/1987 | Darling | |
| 4,715,605 | A | * | 12/1987 | Fritzman | 273/156 |
| 5,312,113 | A | * | 5/1994 | Ta-Hsien et al. | 463/9 |
| 5,393,062 | A | * | 2/1995 | Cember | 273/153 R |
| 5,423,556 | A | * | 6/1995 | Latypov | 463/9 |
| 5,427,375 | A | | 6/1995 | Breckwoldt | |
| 5,484,287 | A | | 1/1996 | Concepcion-Diaz | |
| 5,643,085 | A | * | 7/1997 | Aityan et al. | 463/9 |

(Continued)

FOREIGN PATENT DOCUMENTS

SU 1146072 A * 3/1985

(Continued)

OTHER PUBLICATIONS

Foreign Patent No. SU 1227226 A1 (5 pages).*

(Continued)

*Primary Examiner*—Peter DungBa Vo
*Assistant Examiner*—William H McCulloch

(57) ABSTRACT

A mechanical and electronic combinatory game and puzzle includes a plurality of cubic game items (2) bearing patterns on the faces, arranged in crossing rows in an overall parallelepiped game structure (1). Pre-designed or new face pattern combinations are to be obtained through sequences of group spinning. Variants of the game may include spinning partial or entire rows (4), as well as translations of game items if the game structure (1) contains empty places. The mechanical embodiment provides an overall parallelepiped game structure (1), an expandable enclosure (7) and handling devices (15). The electronic embodiment provides computer representation (40), control and management of the play.

9 Claims, 7 Drawing Sheets

U.S. PATENT DOCUMENTS 5,785,319 A * 7/1998 Frauhiger ..... 273/157 R
5,785,320 A 7/1998 Borg
5,803,461 A 9/1998 Pavlovic
5,857,673 A * 1/1999 Ablonczy et al. ..... 273/153 S
5,921,548 A * 7/1999 Goldberg ..... 273/157 R
6,027,117 A * 2/2000 Goldberg ..... 273/157 R
6,029,383 A * 2/2000 Zappitelli ..... 40/720
6,062,978 A * 5/2000 Martino et al. ..... 463/9
6,186,860 B1 2/2001 Liao
6,237,914 B1 * 5/2001 Saltanov et al. ..... 273/157 R
6,352,475 B1 * 3/2002 Mraovic ..... 463/9
6,422,560 B1 * 7/2002 Harbaugh ..... 273/157 R
6,458,032 B1 * 10/2002 Yamagami ..... 463/9
6,460,854 B1 * 10/2002 McCarey ..... 273/272
6,579,177 B2 * 6/2003 Mraovic ..... 463/9
6,878,059 B2 * 4/2005 Boeru ..... 463/9
7,094,147 B2 * 8/2006 Nakata et al. ..... 463/9
2002/0094857 A1 * 7/2002 Meyer ..... 463/16
2002/0167129 A1 * 11/2002 Stanton ..... 273/283
2002/0175472 A1 * 11/2002 Boeru ..... 273/441
2003/0040350 A1 * 2/2003 Nakata et al. ..... 463/9
2003/0199293 A1 * 10/2003 Skripachev et al. ..... 463/9
2003/0232636 A1 * 12/2003 Ionescu ..... 463/9

FOREIGN PATENT DOCUMENTS

SU 1227226 A1 * 4/1986
SU 1505561 A1 * 9/1989

OTHER PUBLICATIONS

Foreign Patent No. SU 1505561 A1 (9 pages).*

* cited by examiner

MECHANICAL AND ELECTRONIC COMBINATORY GAME AND PUZZLE

CROSS-REFERENCE TO RELATED APPLICATIONS

This application claims the benefit of the Provisional Patent Application Ser. No. 60/388,940, filed on Jun. 14, 2002.

STATEMENT REGARDING FEDERALLY SPONSORED RESEARCH OR DEVELOPMENT

Not applicable.

REFERENCE TO A COMPUTER PROGRAM LISTING COMPACT DISK APPENDIX

The code listing referred in the present description is recorded on a compact disc, attached as Appendix A. Copyright notice: Unpublished Work© 2002 Pancu Mihai Ionescu.

BACKGROUND OF THE INVENTION

This invention relates to puzzles and logic games, specifically to such puzzles and games where patterns exposed on the faces of a set of equal cubic items can be associated in order to obtain diverse combinations.

It is known that the play is a training for life, induced by a natural inclination to simulate like-situations in order to learn or maintain useful abilities. Therefore, new puzzles and games stimulating the development of mental capacities enjoy a large interest in public, offering an appreciated leisure alternative.

BRIEF SUMMARY OF THE INVENTION

In accordance with the present invention a combinatory game and puzzle comprises electronic representations of a game set of cubic game items bearing patterns on the faces, arranged in crossing rows in an overall parallelepiped game structure, allowing spinning groups of game items in any row. In a variant of the game, translations of game items may be possible too, if empty places are included in the game structure. The players are supposed to try interactively to form interlaced face pattern combinations by manipulating groups of game items.

An object and advantage of the present invention is to provide a game and puzzle meant to stimulate the perception of group acting, where the properties of the members are to be considered in combination. Handling concurrent groups sequentially generates multiple effects that are to be anticipated and managed conveniently in order to reach predetermined goals.

Some of the further objects and advantages of the electronic embodiment of the present invention are:

- to provide an electronic game able to be played on personal computers, video-game units or other existing types of computer systems;
- to provide an electronic game surprisingly mimicking the spinning of a plurality of cubic items and precisely memorizing and rendering the appearances and orientations of their faces;
- to provide an electronic game offering a plurality of choices and options like the type of the game, the number of cubic items in the game, the playtime, the number of play-rounds, the number of players, the way to validate the results and the possibility to save the results;
- to provide an electronic game where the startup configuration may be changed, however being kept consistent with predetermined criteria, like the total number of each face-pattern, the random/controlled selection and distribution of the face-patterns and the random/controlled shuffling of the cubic items; and
- to provide an electronic game where the course of the game could be managed by the program, which also could count, verify, validate and save the results, and establish the rankings.

Other objects and advantages of the present invention will become apparent from the following descriptions, taken in connection with the accompanying drawings, wherein, by way of illustration and example, several embodiments of the present invention are disclosed.

BRIEF DESCRIPTION OF THE DRAWINGS

The drawings constitute a part of this specification and include exemplary embodiments of the invention. It is to be understood that in some instances various aspects of the invention may be shown exaggerated, reduced, enlarged or simplified to facilitate an understanding of the invention.

DETAILED DESCRIPTION OF THE INVENTION

Detailed descriptions of the preferred embodiments are provided herein. It is to be understood, however, that the present invention may be embodied in various forms. Therefore, specific details disclosed herein are not to be interpreted as limiting, but rather as a basis for the claims and as representative examples teaching one skilled in the art to employ the present invention in virtually any appropriately detailed system, structure or manner.

Here below, the preferred embodiment of the invention will be described as a method of playing the combinatory game and as a program reproducing and displaying the functionality of this game on a computer system. The detailed presentation of the preferred embodiment of the invention, based on the relevant drawings, FIG. 1 through FIG. 26 FIG. 1 through FIG. 4, FIG. 12 through FIG. 14, FIG. 18 and FIG. 20 through FIG. 26, as well the detailed listing of the computer program recorded on the compact disc attached as Appendix A, are meant to give to those skilled in the art the possibility to use the invention easily, however, it shouldn't be considered that the invention is limited to these examples. Numerous other examples of embodiment of this invention may be developed using the claims as a basis and changing or adding state of the art, equivalent or obvious features and methods, however all shall be considered within the scope of this invention.

Method Embodiment Description

Figure 4:
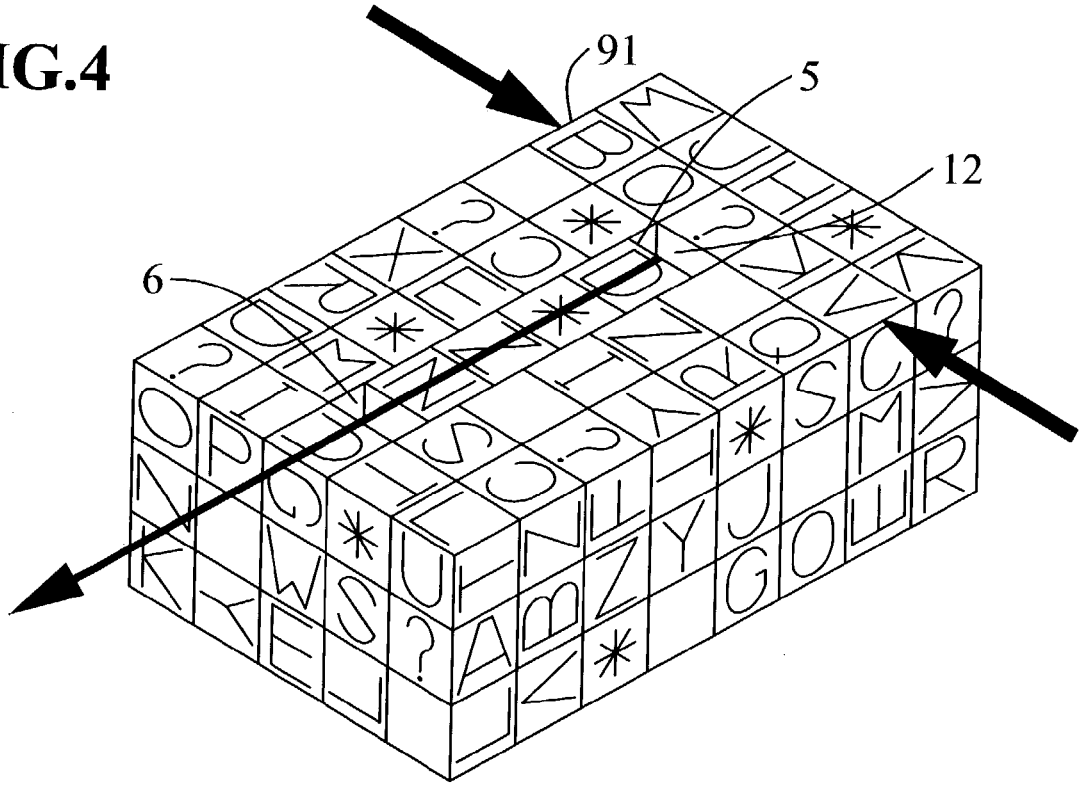
FIG. 4 illustrates an isometric view of a game-structure like in FIG. 1 that includes an empty-place, while a horizontal group of game-items is translating.
Figure 12:
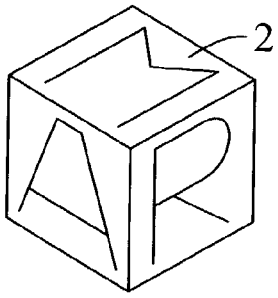
FIG. 12 illustrates an enlarged isometric view of a cubic game-item, providing letters as face-patterns.
Figure 13:
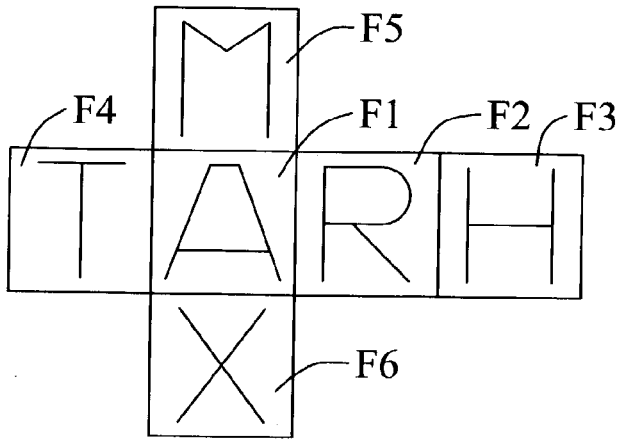
FIG. 13 illustrates an unfolded view of the game-item in FIG. 12.

A preferred embodiment of the method of playing the combinatory game of the invention is featured mainly in FIG. 1 through FIG. 4, as a physical representation. It is to be understood that the electronic game will mimic this representation on a computer screen, as shown farther on. The basic part of the combinatory game is a game-structure 1, presented in FIG. 1, shaped like a compact rectangular parallelepiped and composed of a predetermined number of game-items 2, referred as game-set, which counts one hundred and twenty in this example. The featured game-items are represented in detail in FIG. 12. A game-structure may have either several layers of game-items, like game-structure 1 in FIG. 1, giving a three-dimensional or spatial game-structure, or just one layer of game-items, like game-structure 37 in FIG. 18, giving a two-dimensional or flat game-structure. Game-items 2 are arranged in rows parallel with the sides of game-structure 1, so that they can form groups of elements to be handled together, meaning that they can be spun in steps of 90 degrees, or that, if at least one game-items is missing in the game-structure, they can be translated into the available empty-place. For instance, in FIG. 2, a vertical row 3 is shown while it spins and in FIG. 3, a horizontal row 4 is also shown while it spins. The thick arrows at the ends of rows 3 or 4 show that the game-items in these rows are held together in order to be spun simultaneously. In FIG. 4, a group 5, formed by four game-items exposing the face-patterns "D", "*", "Z" and "N", is shown while translating into an empty-place 6, in the direction of the long arrow. The thick arrows at the ends of row 91 show that the game-items in that row are held together in order to be separated of translating group 5. A new empty-place 12 will be created when the translation is completed.

Figure 14:
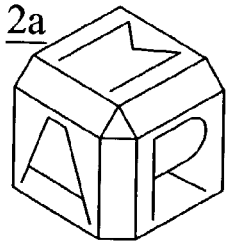
FIG. 14 illustrates an enlarged isometric view of a more general variant of the game-item, a cube-like game-item, providing letters as face-patterns.
Figure 18:
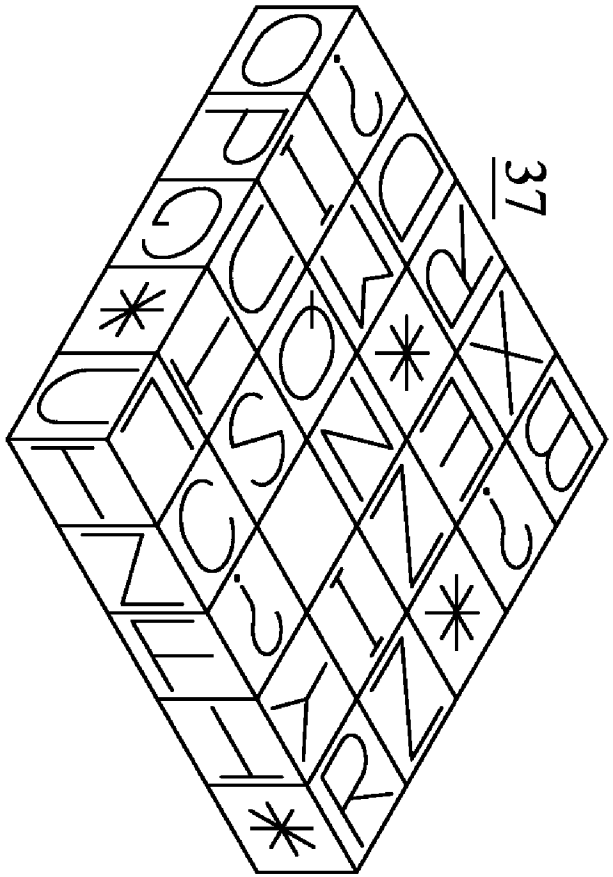
FIG. 18 illustrates an isometric view of a flat and square game-structure composed out of game-items and providing letters, spaces, question marks and asterisks as face-patterns.

The interest of handling together the game-items, featured in a more general representation in FIG. 14 as a cube-like game-item 2*a*, emerges from the fact that each game-item has six faces, like the faces of a cube, interconnected and able to take different orientations rotated by 90 degrees, but occupying the same space. If a different pattern, referred as face-pattern, is printed on each face, the game-item will present a number of properties equal to the number of faces multiplied by the number of positions a face can take while in the structure, which is four, giving twenty four properties. A row of several game-items can show a very large number of combinations of properties of different game-items, referred as face-pattern combinations. However, handling each game-item individually provides an easy way to obtain any aimed and possible face-pattern combination, presenting little interest for a game. The novelty brought by the invention is that the game-items can only be handled in groups, namely entire rows or parts of rows, resulting in changes in all the perpendicular rows crossing the handled group. Finally, in order to obtain predetermined face-pattern combinations, elaborate sequences of spinning and possibly translations have to be imagined and performed.

Here below, some examples of games and puzzles aiming to obtain different types of face-pattern combinations are presented. At the beginning of the game, a shuffling operation should be done. A random-shuffling operation can be defined as taking out, mixing and randomly replacing the game-items in the game-structure, while a controlled-shuffling operation can be defined as starting with an arranged game-structure and only applying a number of random spins and, if possible, random translations to different groups of game-items in a row, so that it can be assured that the arranged game-structure can be re-created by these type of operations. An exemplary embodiment of such an operation of the combinatory game is included in the program listing in Appendix A.

Figure 1:
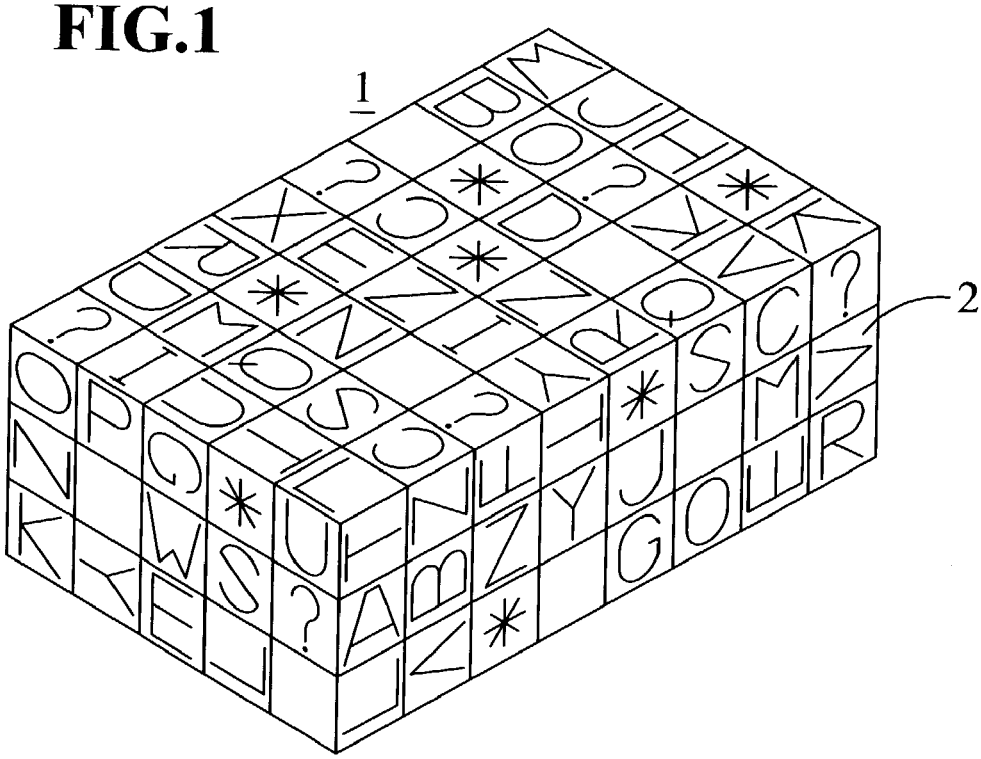
FIG. 1 illustrates an isometric view of a game-structure formed by cubic game-items disposed like a rectangular parallelepiped, providing letters, spaces, question marks and asterisks as face-patterns.
Figure 2:
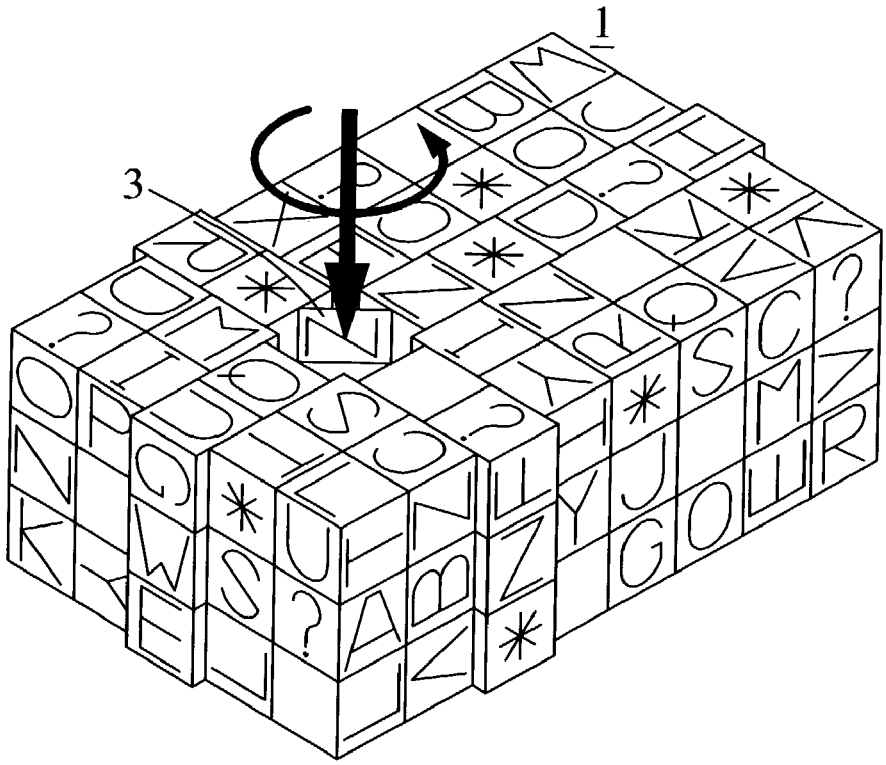
FIG. 2 illustrates an isometric view of the game-structure in FIG. 1, while a vertical row is spinning.
Figure 3:
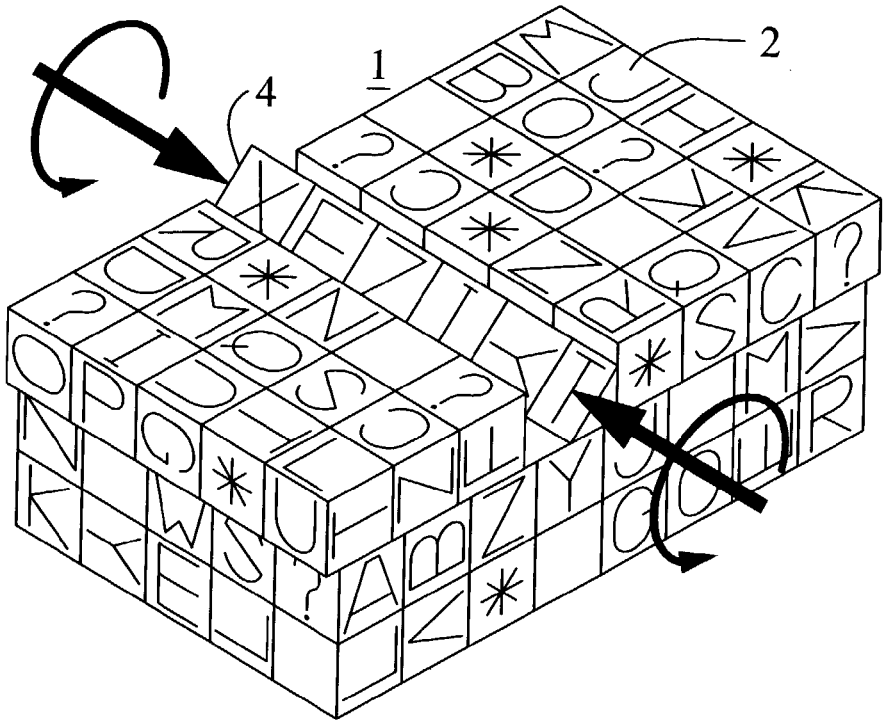
FIG. 3 illustrates an isometric view of the game-structure in FIG. 1, while a horizontal row is spinning.

A letter game will comprise game-items having individual letters or special characters as face-patterns, like in FIG. 1. A special character may be a space that separates two words, a question mark representing any letter the player would choose, or an asterisk representing any group of three letters the player would choose to end the preceding word or to begin the following the word. The face-pattern combinations to be obtained may be words, alphabetic suites or groups of same letter or same orientation. The distribution of different letters of the alphabet on the faces of the game-items in the game-set may be done randomly, or according to certain rules. For instance, the total number of occurrences of a letter in the game-set may be proportional with its frequency of usage in the English language and then the available number of each letter may be randomly distributed among different game-items, never twice on the same. Further on, the six letters or special characters selected for one game-item may be placed, in the order of their selection, on faces F1 through F6 of the game-item, in the same orientation, as in FIG. 13. When the game-items are spun, the orientation of the letters changes, resulting for instance into a situation like in FIG. 1. An exemplary embodiment of such a combinatory game is included in the program listing in Appendix A.

A color game will comprise game-items having each face painted in a different color, for instance face F1 in red, face F2 in blue, face F3 in yellow, F4 in green, face F5 in brown and face F6 in cyan. If initially all the game-items are disposed with the faces oriented identically, showing uniform color patterns on the sides of the game-structure, after a controlled-shuffling the aspect will be heterogeneous. The purpose of the game will be to obtain the initial uniform color pattern, or the largest uniform color spot. An exemplary embodiment of such a combinatory game is included in the program listing in Appendix A.

A color and letter game may combine the two games described before, by using game-items that have both letters and color patterns on their faces. The purpose will be to obtain both letter and color combinations, or either one. An exemplary embodiment of such a combinatory game is included in the program listing in Appendix A.

An alphabet colored game will comprise game-items with the six faces colored differently, but bearing the same letter. The number of letters used shall allow arranging the game-items in alphabetic order, either complete alphabets following each other over the entire game-structure, or similar alphabet suits for each row. The translation shall be possible, by providing at least one empty-place in the game-structure. After a controlled-shuffling, the exposed assembly of letters and colors will look very disordered, challenging the player to recover the initial formation using the handling possibilities of the game. Two exemplary embodiments of such a combinatory game are included in the program listing in Appendix A.

A picture game will expose initially one picture for each side of the game-structure when the game-items are exposing the same face, with the same orientation, meaning that each picture will be divided into square portions printed on the game-item faces. Each of the six uniform orientations of the game-items belonging to a game-structure side may form another picture. After a controlled-shuffling, the square parts of the initial picture will be mixed up, challenging the player to recover the initial formation using the handling possibilities of the game.

A "hide and find" game will provide one or several special game-items with particular face-patterns, which will be hidden by shuffling. The challenge for the player will be to find these special game-items and place them into particular face-pattern combinations.

Beside the challenge to reposition the game-items, the time necessary to obtain a result, the number of moves used to reach a goal and the number of game-items included into a face-pattern combination, for instance, may also constitute criteria to measure the performances of a player or team of players, opening new challenges to beat the records. Exemplary embodiments of such features of a combinatory game are included in the program listing in Appendix A. Other embodiments can be easily created using the novelty concepts of this invention and adding obvious changes to the preferred embodiment, like for instance various models of cube-like game-items, various numbers of game-items and empty-places in the game-structure, various types, numbers and locations of the face-patterns, further handling or blocking operations. However, all these variants shall be considered within the scope of this invention delimited by its claims.

Other specific details and variants of the method embodiment are presented within the description of the electronic embodiments of the combinatory game.

Accordingly, the reader will see that the method of playing the combinatory game and puzzle of this invention provides an attractive and efficient method to stimulate the perception of group action, which requires the player to consider the properties of the group members in combination. The multiple effects obtained when handling concurrent groups sequentially are to be anticipated and managed conveniently in order to reach predetermined goals, which develops specific mental abilities and provides a challenging entertainment.

Furthermore, the combinatory game has additional advantages in that:

- it allows forming interactive and interlaced combinations of predetermined or variable numbers of face-patterns;
- it allows creating various and interesting games and puzzles adopting different ways of expression, like words, numbers, colors, and pictures, that can cover various thematic.
- it provides a straightforward way to play, leading to games easy to learn, however very reach in possibilities and issues; and
- it can be easily transposed into electronic embodiments.

Electronic Embodiment Description

A preferred electronic embodiment of the combinatory game of the invention is presented mainly in FIG. 20 through FIG. 26. The programming methods and the code organization presented in detail hereafter are using Microsoft Visual Basic 6.0 for Windows programming software as development tool, however, they can easily be adapted to use other programming software. Such a visual type of programming software provides a large choice of control tools to be used in interactive software application for existing computer systems, for instance in order to handle graphics and data on an electronic display in relation with the player operation. The source code listing recorded on compact disc is attached to the present description in Appendix A and represents for those skilled in the art a very detailed description of how to materialize the invention electronically, giving complete understanding of the procedures to be used for. Such a source code can be used to create executable programs to run on a computer system of a known type (not shown), comprising hardware as:

- a processor unit, like a personal computer or video-game unit, known to comprise subunits for processing, calculation, storage and exchange of data, as well as for interface with other units of the computer system and with other computer systems (not shown);
- a display or screen, like a personal computer monitor or a Liquid Crystal Display,
- a keyboard, like a personal computer keyboard or a dedicated keyboard comprising only the necessary keys, either material or displayed on the screen,
- a pointing device, like a personal computer mouse, trackball or other device having a similar functionality, and the software necessary to operate this hardware. While running, the executable program displays on the screen images reproducing the game-structure and the game-items, as well as their movements, and the player can handle them by using the controls displayed on the screen, the pointing device or the keyboard in order to obtain the effects of spin or translation, in a similar manner like when using the material game-device.

Figure 20:
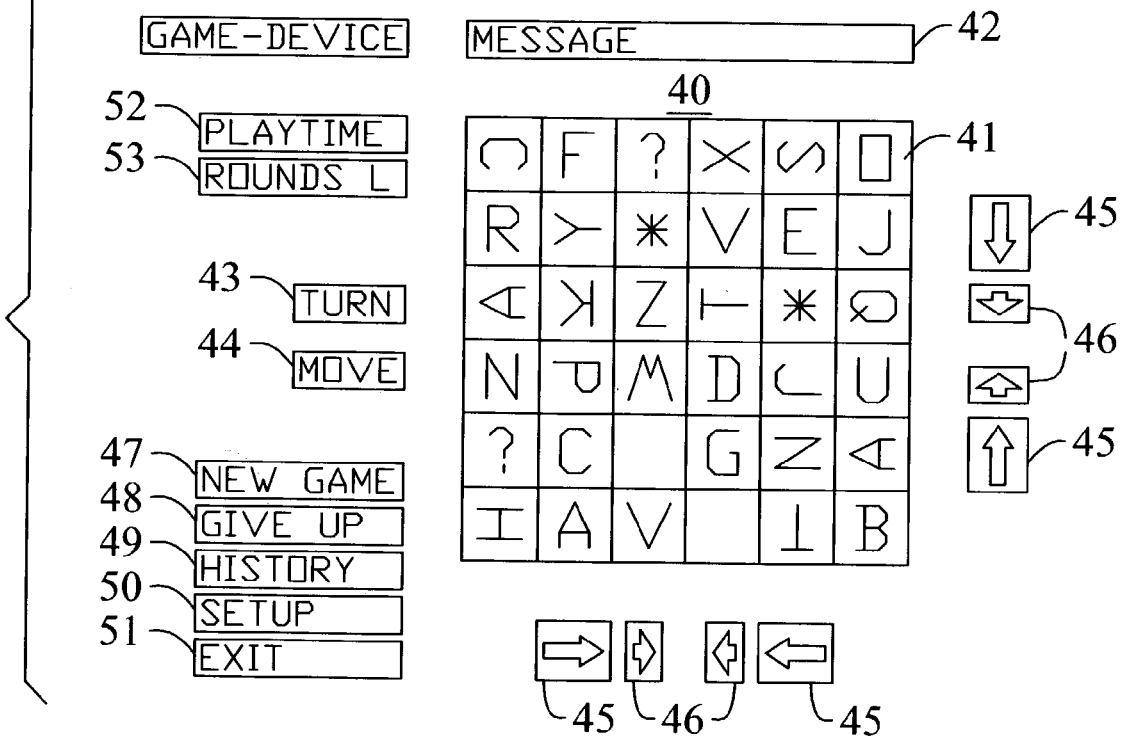
FIG. 20 illustrates a general layout of a screen "GAME DEVICE" displaying an electronic embodiment of the combinatory game, containing the game-structure and the controls, and providing letters, spaces, question marks and asterisks as face-patterns.

The main elements appearing on the screen during the play are shown in FIG. 20, which represents the layout of a screen referred as "GAME DEVICE". A game-structure image 40 reproduces the plane view of a material game-structure like game-structure 37 in FIG. 18, and is composed of game-item images 41, visualized as an array of square images representing their top face-patterns. However, the number of game-items per side of game-structure is adjustable. Due to the flat game-structure, the generic references of "horizontal rows" and vertical rows" may be replaced respectively by the terms "rows" and "columns". A label 42 is used to display messages for the player, for instance what action he's expected to do, like: "Select ROW/COLUMN; turn either one." or "Click on a CUBE to move, if possible". Two labels, "TURN" 43 and "MOVE" 44, allow the selection of the intended type of handling: spin, respectively translation. Four buttons 45 serve to initiate the spin by 90 degree in their arrow direction. Four buttons 46 serve too initiate the spin in their arrow direction by an angle inferior to 45 degree, just big enough to allow seeing the face-pattern of the coming face, and the return to the initial position after the release of the pointing device. A button "NEW GAME" 47 serves to start a new game, a button "GIVE UP" 48 serves to abort a running game before its end, a button "HISTORY" 49 serves to open a screen "HISTORY", represented in FIG. 26, a button "SETUP" 50 serves to open a screen "SETUP", represented in FIG. 25, and a button "EXIT" 51 serves to close the game program. A label 52 displays the current playtime available to accomplish a play-turn and a label 53 displays the number of play-rounds left till the end of the current game. Some of the proposed games may be played by one or several players and are organized in play-rounds and play-turns. During a play-turn, which has a limited duration referred as playtime, a player can accomplish a certain number of actions, as for instance two row spins, after which he is prompted to select a result. A play-round lasts until all players accomplish one play-turn. The game ends when a certain number of play-rounds have been completed. Other proposed games end when a certain configuration is obtained. The code listing in Appendix A, which is part of this detailed description, also contains other elements that may appear on the screen and also shows that and the visibility of the elements on the screen can be turned on and off at different times.

Figure 21:
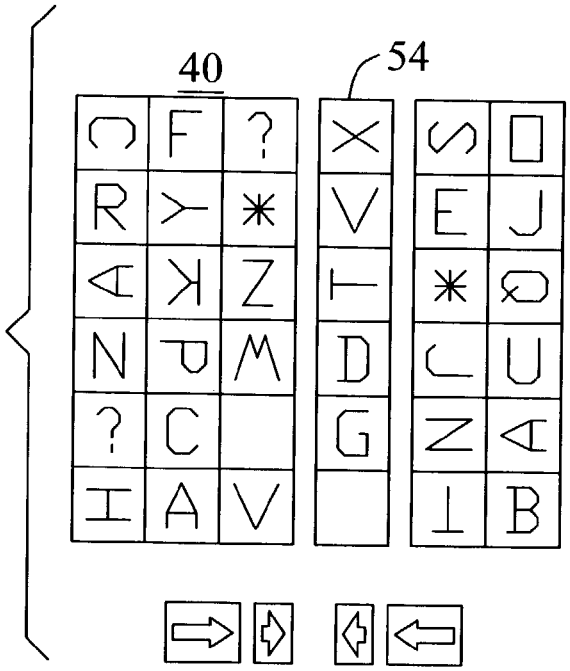
FIG. 21 illustrates an instant detail of the screen in FIG. 20 that appears when selecting a vertical row for spinning.
Figure 22:
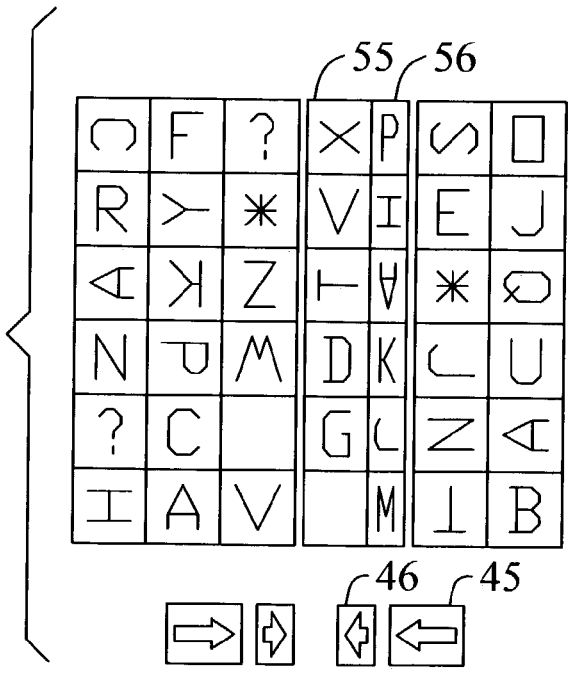
FIG. 22 illustrates an instant detail of the screen in FIG. 20 that appears when the selected vertical row is spinning gradually.

The way chosen to represent the spinning of a column is shown in FIG. 21 and FIG. 22. When a column 54 is selected, the remaining columns will offset, like in FIG. 21, in order to better visualize it. After selection, buttons 45 and 46 become active and can initiate the spin, which is represented in FIG. 22: the current images in a column 55 gradually shrink while the new images in a column 56 gradually expand, giving the impression of a column spinning. The rows are spun in a similar manner.

Figure 23:
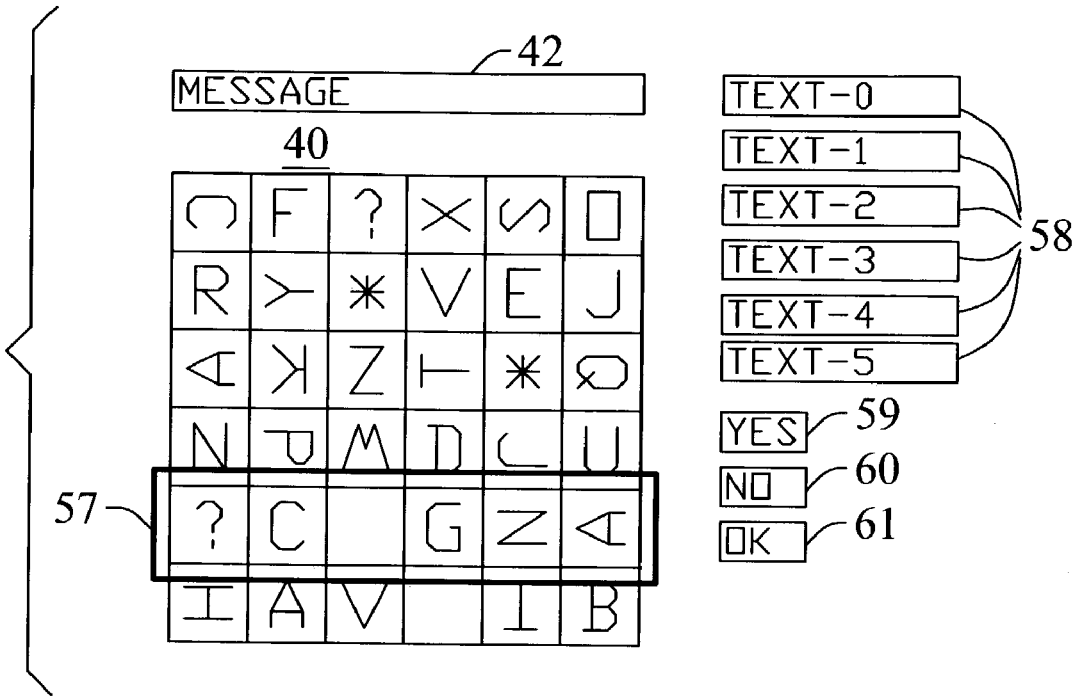
FIG. 23 illustrates an instant detail of the screen in FIG. 20 that appears when a horizontal row is pointed on, while looking for results.

The way chosen to represent the selection of the row results is shown in FIG. 23: as the pointing device is moving over game-structure 40, a mobile frame 57 appears, jumping from row to row. When a row is selected for results, labels 58 will display different results and, at the end of the play-turn, the current ranking. The column results are represented in a similar manner. When a question mark or asterisk is included in the result, the player is prompted to enter one, respectively three letters in a text box (not shown), which he validates by clicking on a button "OK" 61. The final result is accepted or rejected by clicking on either a button "YES" 59 or a button "NO" 60.

Figure 24:
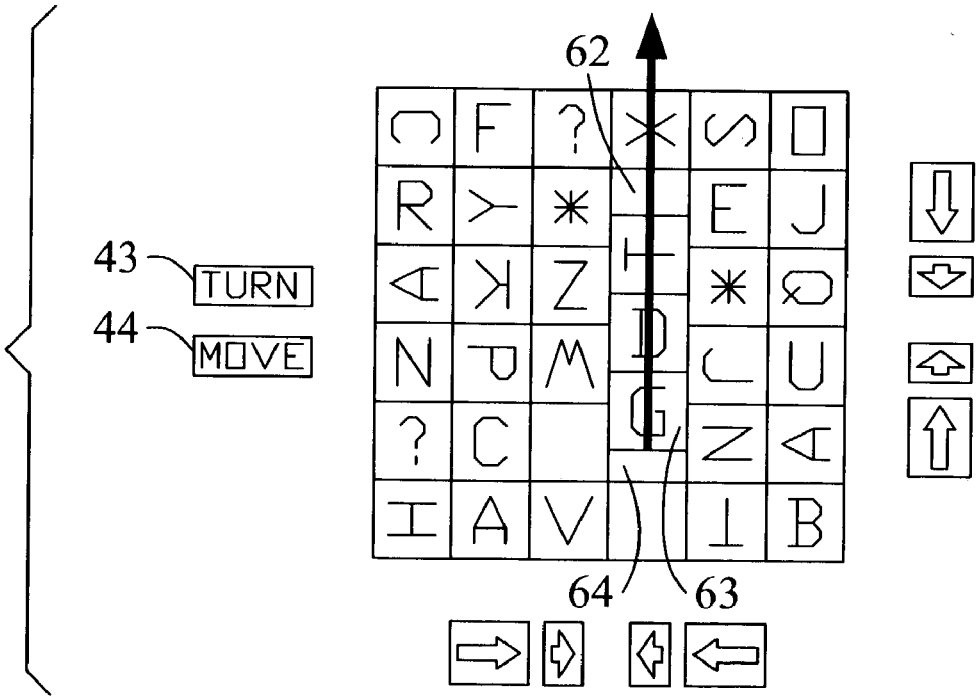
FIG. 24 illustrates an instant detail of the screen in FIG. 20 that appears when the selected type of game allows both translation and spinning, when a group of game-items is translating gradually.

The way chosen to represent the translating of a group of game-items is shown in FIG. 24: if initially an empty-place 62 exists and the translation type of handling is selected with label "MOVE" 44, the click on a game-item 63 will initiate the gradual translation of the group starting with this game-item and ending at the empty-place, composed in this case of three game-items exposing the face-patterns "G", "D" and "T", until a new empty-place 64 will be created.

Figure 25:
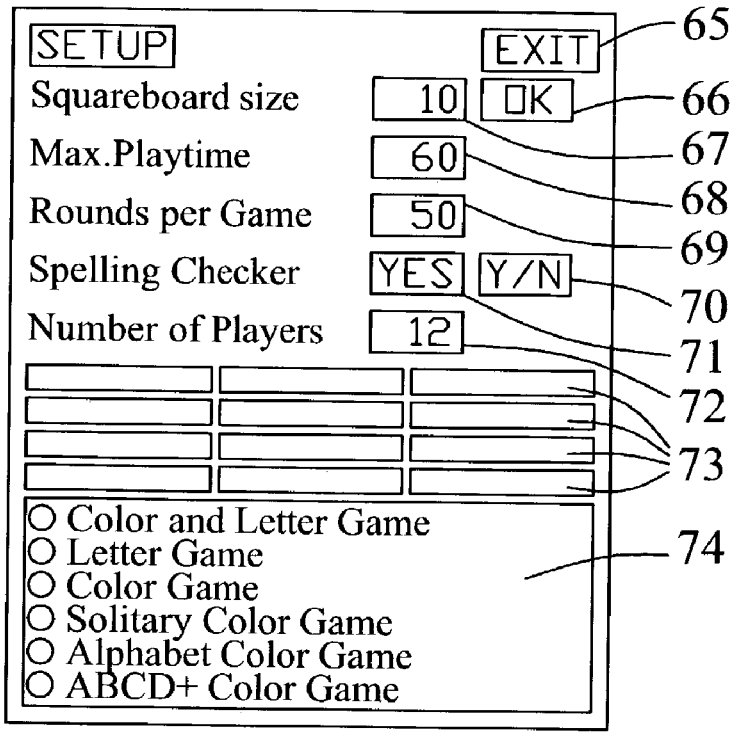
FIG. 25 illustrates a screen "SETUP" used to select the game type and the main options.

The options of the game can be adjusted or selected in screen "SETUP", represented in FIG. 25, which appears when clicking on button "SETUP" 50. In this screen, a button "EXIT" 65 ends the setup and closes the screen, a button "OK" 66 validates the entry in a text box 67 for the number of game-items per side of game-structure, a text box 68 is used to enter the maximum playtime, a text box 69, is used to enter the maximum number of play-rounds per game, a button "Y/N" 70 is used for selecting a spelling checker, if available, a label 71 shows the status of the spelling checker, a text box 72 is used to enter the number of players, text boxes 73 are used to enter the names of the players and an option box 74 is used for selecting the type of game among the following options: "Color and Letter Game", Letter Game", "Color Game", "Solitary Color Game", "Alphabet Color Game" and "ABCD+ Color Game".

A game "Color and Letter Game" consists in making words of two or more letters and uniform color spots of three or more places in a row. During a play-turn, only rows or only columns can be spun a number of times, and the resulting words or uniform color spots are selected on the perpendicular direction. Only the longest word and the longest uniform color spot in the result column or in the result row count. The results in each play-round and for each player are cumulated, and after each play-turn the current ranking is displayed in labels 58. The game ends after a certain number of play-rounds and the final ranking is displayed. The history of the results is saved and can be reviewed by clicking button 49 "HISTORY", which opens screen "HISTORY" represented in FIG. 26. In this screen, the results obtained by a player, whose name is selected in a list 75, will be displayed in a list 76. All the results may be saved in a file, the file name being adjustable in a text box 77, by clicking on a button "SAVE" 78. A button "EXIT" 79 is used to close screen "HISTORY".

A game "Letter Game" is similar with game "Color and Letter Game", but consists in making words only.

A game "Color Game" is similar with game "Color and Letter Game", but consists in making uniform color spots in a row only.

A game "Solitary Color Game" is a game where the game-items have only colors as face-patterns and there's an empty-place in the game-structure, so that the translation is possible, besides spinning. As the game-items are initially shuffled, the purpose of the game is to obtain as large uniform color spots as possible, respectively entire game-structure faces, in the shortest time. The program counts the number of game-items in the largest uniform color spot, detects the accomplishment of an entire face or of all the faces of the game-structure, displays corresponding messages to the player and memorizes the records.

A game "Alphabet Color Game" is similar with game "Solitary Color Game", but each game-item has also, as face-pattern, a letter printed on all six faces. The occurrences of the different letters are so that continuous alphabet suits can be obtained over the entire game-structure, which is the purpose of the game.

A game "ABCD+ Color Game" is similar with game "Alphabet Color Game", but the occurrences of the different letters are so that continuous alphabet suits can be obtained either on each row, or on each column, which is the purpose of the game.

The code listing in Appendix A comprises the following files: "Setup-form.txt", "Generalbas.txt", "Game-item-cls.txt", "Game-device-form.txt" and "History-form.txt", which use standard ASCII character and files formats. These files can be read using any text processing software, as for instance the Microsoft Windows Notepad, which is included in all versions of Microsoft Windows for personal computers. Most of the names chosen for variables and functions, or the associated remarks, are suggesting their role in the program, so that it's easy for those skilled in the art to understand how the program works. As the code represents itself a very detailed description of the embodiment of the invention into a program, the presentation that follows is meant to indicate mainly the link between the references in FIG. 20 through FIG. 26 and the different parts of the code.

"Setup-form.txt" is the listing of a code that controls screen "SETUP" in FIG. 25. The elements referenced in FIG. 25 are controlled by subroutines as mentioned hereafter.

Button "EXIT" 65 is controlled by a subroutine "Exit_Click", which applies new settings to the program.

Button "OK" 66 is controlled by a subroutine "DistributeLetters_Click", which distributes the face-patterns to the game-items. In this respect, the code calculates the total number of faces and the total number of occurrences of each face-pattern, so that to respect certain relative proportions, which in the case of letters are the frequencies of usage in the English language. Then the face-patterns, letters and special characters in this case, are randomly distributed to different faces, but never twice to the same game-item.

Text box 67, used for entering the number of game-items per game-structure side, is controlled by a subroutine "SquareSize_Change".

Text box 68, used for entering the maximum playtime, is controlled by a subroutine "Text2_Change".

Text box 69, used for entering the maximum number of play-rounds per game, is controlled by a subroutine "Text3_Change".

Button "Y/N" 70, used for selecting the spelling checker, is controlled by a subroutine "Command1_Click".

Label 71 showing the status of the spelling checker is controlled by a variable "Label9.Caption".

Text box 72, used for entering the number of players, is controlled by a subroutine "Text4_Change".

Text boxes 73, used for entering the names of the players, are controlled by a subroutine "Text5_Change".

Option boxes 74, used for selecting the type of game, are controlled by a subroutine "Option1_Click".

"General-bas.txt" is the listing of a program module declaring and setting up the general variables used by the other program modules according to the options selected by a player in screen "SETUP". It calculates the number of game-items 41 and initializes an array "Game_item" that will contain all their characteristics. It also initializes the type of the game, contained in a variable "PintGameType", certain text messages and certain default values.

"Game-item-cls.txt" is the listing of a code defining the game-item by storing its properties and functions. The referred properties are: the number of faces, the interconnections between the faces, the addresses of the face-pattern picture of each face, and the identity and orientation of the current face, that is the one which is currently visible on screen as top face. The identities of the six faces are expressed by the numbers 1 through 6. A face can take four orientations, up, right, down and left, referenced respectively by the numbers 1 through 4. All the interconnections between the faces, as existing on the material game-item, are stored by a function "Class_Initialize" into an array "mintTurn", as correspondences between, on one hand, the identity and orientation of one face and the direction of connection, and on the other hand, the identity and orientation of the connected face. The four turning directions, up, right, down and left are referenced respectively by the numbers 1 through 4. A function "TurnUp" can return the identity and orientation of the new face appearing when the current face would turn in a certain direction, by reading into array "mintTurn", while a function "EndTurnUp" updates the properties of the turned game-item. Each possible face-pattern, in each color and each orientation is stored as a picture either as a bitmap file or as a record in a resource file grouping all the bitmap files used in the program. In this case, there're 26 letters and 3 special characters, each in 6 colors and 4 orientations, giving a number of 696 pictures stored in a resource file, where they are identified by the numbers 101 through 796. Code "Game_item.cls" returns the identity of the picture of the current top face as a property "intResIndexFileFaceUp", and the identity of the picture of the new top face emerging when the game-item spins in a certain direction as a property "intResIndexFileNewFaceUp".

"Game-device-form.txt" is the listing of a code that controls screen "GAME DEVICE" shown in FIG. 20 through FIG. 24. The elements references in FIG. 20 through FIG. 24 are controlled by subroutines as mentioned hereafter.

The general organization of the screen is controlled by a subroutine "Form_Load", which is executed at the beginning of the game and after every setup of the game. This subroutine calculates the size and position of each image 41, depending on the number of game-items in the game-structure so that the game-structure occupies the available space, selects the messages to be displayed and turns on or off the visibility of the elements to be displayed or hidden. This subroutine also calls a subroutine "Shuffle_Click", which operates a controlled-shuffling of the game-items, as defined for the mechanical embodiment of the invention, by applying a number of random spins by 90 degrees to different rows and columns, and if possible, by applying a number of random translations to different groups of game-items.

Image 40 of the game-structure, composed of individual images 41, is defined as an array "Image1". Another array, "Image2" is defined and used to show the pictures of the new faces, appearing when the game-item spin.

Images 41, used to display the pictures of top faces of the game-item, are members of array "Image1" and are controlled by following subroutines: "Initialise_Click", which controls the loading of each face-pattern picture into the corresponding image, "Image1_Click", which controls the selection of images to be handled and "Image1_MouseMove", which controls the selection of the images to be included in the results. Following subroutines are called to manage the selection of different groups of images 41: "Sel_TRow", which selects the row to be spun, "Sel_TCol", which selects the column to be spun, "Row_Move", which selects the group of game-items in a row to be translated, "Col_Move", which selects the group of game-items in a column to be translated, "Sel_RRow", which selects the row to be considered as result, and "Sel_RCol", which selects the column to be considered as result.

Label 42, used to display messages, is controlled by a property "Label3.Caption".

Label 43, used to select "TURN" option, is controlled by a subroutine "Label16_Click". The effective spinning of the game-items is initiated by buttons 45.

Label 44, used to select "MOVE" option, is controlled by a subroutine "Label17_Click". The effective translation of game-item is initiated by clicking with the pointing device on the last game-item in the group and consequently is controlled by subroutine "Image1_Click" mentioned above. A subroutine "Timer6_Timer" is called to refresh the image of the translating group, frequently enough to produce an impression of continuous movement. Each time the preset timer elapses, a new intermediary instance of each "Image1" member in the group is displayed. The translation is possible only if there's an empty-place before the translating group, where the empty-place is represented by turning off the visibility of the respective "Image1" member. The end of the movement is accomplished by restoring the initial position of each "Image1" member in the group and by transferring all the properties from one game-item to the next one in an enlarged group, which is formed by the invisible game-item plus the translating group, and by turning off the visibility of the last game-item in the enlarged group.

Buttons 45, used to initiate the spinning, are controlled by a subroutine "Turn_Click". A subroutine "Timer1_Timer" is called to refresh the image of the spinning group of game-items, either row or column, frequently enough to produce an impression of continuous movement. Each time the preset timer elapses, it calculates the intermediary positions and dimensions of each "Image1" member and "Image2" member in the group. Considering only the dimension parallel with the spinning direction, at the beginning, each "Image1" member has full width, while each "Image2" member has zero width and is invisible. During spinning, each "Image2" member becomes visible and the width of each "Image1" member and each "Image2" member are calculated as projections on the plane, while their position is adjusted in order to maintain the median axis of theirjoint picture at the same place, as spin axis. At the end, each "Image1" member has zero width and each "Image2" member has full width. A subroutine "EndTurn_Click" is then called to end the movement and to establish the final images. This is accomplished by loading the new face-pattern pictures into each "Image1" member and by restoring the initial dimensions, position and visibility of each "Image1" member and each "Image2" member in the spun group.

Buttons 46, used to initiate the partial spin and return, are controlled by subroutines "Peep_MouseDown" and "Peep_MouseUp". Subroutines "Timer2_Timer" and "Timer3_Timer" are called to refresh the images of the spinning game-items, in a similar manner like subroutine "Timer1_Timer" mentioned above.

Button 47, used for starting a new game, is controlled by a subroutine "Command3_Click".

Button 48, used abort the game in certain conditions, is controlled by a subroutine "Command5_Click".

Button 49, used for calling screen "HISTORY", is controlled by a subroutine "Command6_Click". The source code listing for this screen is "History-form.txt", presented farther below.

Button 50, used for calling screen "SETUP", is controlled by a subroutine "Setup_screen Click". The source code listing for this screen is "Setup-form.txt", presented here before.

Button 51, used to end the program, is controlled by subroutines "Command7_Click" and "Command8_Click".

Label 52, used to display the playtime left in a play-turn, is controlled by a property "Label8.Caption", while the actions performed when the playtime elapses are controlled by a subroutine "Timer4_Timer".

Label 53, used to display the number of play-rounds left in a game, is controlled by a property "Label9.Caption".

The selection of column 54 to be spun is accomplished by subroutine "Sel_TCol".

Images 55 and 56 of a spinning column are controlled by subroutine "Timer1_Timer", presented here before.

Frame 57, used to select the result row or result column, is controlled by the properties of lines "Line1", "Line2", "Line3" and "Line4" in subroutine "Image1_MouseMove".

Labels 58, used to display the results, are controlled by the properties of the members of an array "Label2" in a subroutine "Analyse1".

Button 59, used to validate an entry, is controlled by a subroutines "Command1_Click".

Buttons 60 and 61, used to accept or reject a result, are controlled by a subroutine "Command2_Click".

Figure 26:
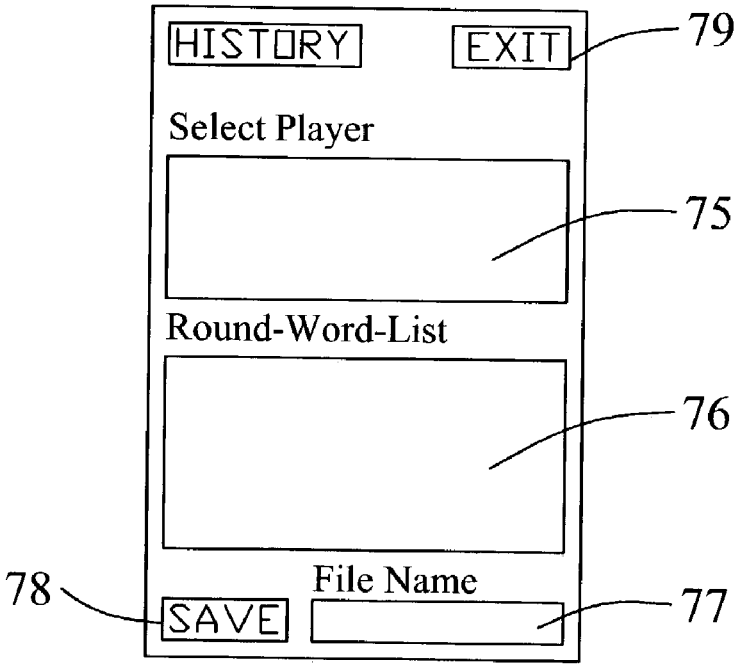
FIG. 26 illustrates a screen "HISTORY" used to review and save the results.

"History-form.txt" is the listing of the code that controls screen "HISTORY" in FIG. 26. The elements referenced in FIG. 26 are controlled by subroutines as mentioned hereafter.

List 75, used to display the name of the players, is controlled by a subroutine "List1_Click".

List 76, used to display the results of a player, is controlled by properties of "List2" list.

Text box 77, used to enter the name of the file storing the results, is controlled by a property "Text1.Text".

Button 78, used to save the results, is controlled by a subroutine "Command2.Click".

Button 79, used to close the "HISTORY" screen, is controlled by a subroutine "Command1.Click".

While the code described above represents the electronic embodiment of a flat game-structure, a spatial game-structure can be embodied electronically using similar methods. Moreover, the novelty concepts of this invention, taken separately or in groups, can generate other forms of electronic embodiments, which are comprised within the scope of this patent.

Accordingly, the reader will see that the electronic embodiment of the combinatory game of this invention is an original game that can be played on state of the art computer systems, like personal computers or video-game units, which surprisingly mimics the spinning of a plurality of cubic items, precisely memorizing and rendering the appearances and orientations of their faces, and allowing to obtain very interesting effects and face-pattern combinations.

Furthermore, the combinatory game has additional advantages in that:

- it provides a plurality of choices and options like the type of the game, the number of cubic items in the game, the playtime, the number of play-rounds, the number of players, the way to validate the results, and the possibility to save the results;
- it provides the possibility to change the startup configuration, however keeping it consistent with predetermined criteria, like the total number of each face-pattern, the random/controlled selection and distribution of the face-patterns and the random/controlled shuffling of the cubic items; and
- it provides the possibility to control the course of the game, to count, verify, validate and save the results, and to establish the rankings.

Although the description above refers to practical examples of realization of the invention that contains many specific details, these shouldn't be construed as limiting the scope of the invention, which should be determined by the appended claims and their legal equivalents.

I claim:

1. A method of playing a combinatory game using computer generated graphics representing a game-set, comprising the steps of:

providing a first predetermined number of equal game-items having a cube-like shape;

providing a collection of face-patterns;

reproducing said face-patterns on the faces of said game-items;

arranging said game-items as an overall parallelepiped game-structure comprising crossing rows of aligned said game-items including zero to a second predetermined number of empty-places equal each to the cubic volume occupied by one said game-item;

performing sequences of spinning comprising each: selecting a spinning group of said game-items in one of said crossing rows, spinning said spinning group around its longitudinal axis by 90 degrees and restoring the initial shape of said game-structure; and aiming to obtain predetermined face-pattern combinations.

2. The method of playing a combinatory game of claim 1, wherein further comprising:

including at least one said empty-place in said game-structure, in said arranging step; and performing sequences of translation comprising each: selecting a translating group formed of contiguous said game-items in a row, adjacent at one end to said one empty-place, and translating said translating group into said one empty-place until a new said empty-place is created behind said translating group.

3. The method of playing a combinatory game of claim 1, wherein further comprising:

selecting a type of said spinning group comprising all said game-items in said one crossing row, in said performing step.

4. The method of playing a combinatory game of claim 1, wherein further comprising:

providing said face-patterns selected from the group consisting of letters, special characters, numbers, colors, pictures, parts of an entire picture, and a combination thereof, in said providing a collection step; and aiming to obtain said predetermined face-pattern combinations selected respectively from the group consisting of words, numeric values, uniform colors, pictures associations, said entire picture, and a combination thereof, in said aiming step.

5. The method of playing a combinatory game of claim 1, wherein further comprising:

choosing a type of said game-structure comprising only one layer of said game-items, in said arranging step; and selecting said spinning group having said longitudinal axis parallel to said layer, in said performing step.

6. The method of playing a combinatory game of claim 1, wherein further comprising:

organizing said game in play-rounds comprising each a third predetermined number of said sequences of spinning having parallel spin axes, each said play-round having to use a different direction of said spin axes than the preceding play-round; and proposing as objective of each said play-round the formation of predetermined said face-pattern combinations comprising said face-patterns in result rows perpendicular on said parallel spin axes.

7. An electronic combinatory game generated on an electronic display of a computer system of a known type, and controlled in response to players' operations on said computer system, comprising the steps of:

storing a collection of digital images to be used as face-patterns;

storing individual properties of a first predetermined number of equal game-items representing each a material cube-like object having one said face-pattern on each face, wherein said specific properties comprise the position, orientation and appearance of each said face in relationship with the position and the orientation of another said face;

calculating and storing position parameters of said game-items arranging said game-items in crossing rows of aligned said game-items including zero to a second predetermined number of empty-places equal each to the cubic volume occupied by one said game-item;

generating images representing views of said game-items arranged as calculated in the preceding step on the display of said computer system; and performing sequences of spinning on the display of said computer system comprising each: selecting a spinning group of said game-items in one of said crossing rows and generating graphics representing said game-items in said spinning group spinning simultaneously around said one row axis and reaching a new stable position at 90 degrees of spin angle.

8. The game of claim 7, wherein further comprising:

including one or several of the following managing steps: selecting the type of said combinatory game, setting up initial options, shuffling said game-items, organizing said combinatory game in play-turns and play-rounds, counting various play-times, checking the spelling in word dames, evaluating and recording the results and the rankings, and saving the game history in files accessible by other applications.

9. The game of claim 7, wherein further comprising:

including at least one said empty-place in the assembly of said crossing rows; and performing sequences of translation comprising each: selecting a translating group of contiguous said game-items in a row, adjacent at one end of said translating group to said one empty-place, and generating graphics representing said game-items in said translating group translating simultaneously into said one empty-place and reaching a new stable position when a new said empty-place is created behind said translating group.

* * * * *